US005790050A

United States Patent [19]

Parker

[11] Patent Number: 5,790,050

[45] Date of Patent: Aug. 4, 1998

[54] METHOD AND APPARATUS FOR A SIGNAL TRANSLATOR

[76] Inventor: Peter Parker, P.O. Box 836, Silverdale, Wash. 98383

[21] Appl. No.: 670,009

[22] Filed: Jun. 25, 1996

[51] Int. Cl.[6] ..... G08G 1/00

[52] U.S. Cl. ..... 340/902; 340/458; 340/438; 340/439; 359/154; 362/36

[58] Field of Search ..... 340/942, 944, 340/438, 458, 439, 326, 902, 903; 359/154; 364/461; 200/61.27; 362/36

[56] References Cited

U.S. PATENT DOCUMENTS

| | | | |
|---|---|---|---|
| 3,144,561 | 8/1964 | Farrell | 340/642 |
| 3,925,763 | 12/1975 | Wadhwani et al. | 340/164 |
| 3,984,803 | 10/1976 | Hawk et al. | 340/16 |
| 4,209,767 | 6/1980 | Flanders | 340/26 |
| 4,223,303 | 9/1980 | Albinger, Jr. | 340/531 |
| 4,234,866 | 11/1980 | Kuroda et al. | 340/642 |
| 4,424,458 | 1/1984 | Buck et al. | 307/361 |
| 4,484,191 | 11/1984 | Vavra | 340/965 |
| 4,777,474 | 10/1988 | Clayton | 340/539 |
| 4,810,996 | 3/1989 | Glen et al. | 340/321 |
| 4,812,746 | 3/1989 | Dallas, Jr. | 324/121 |
| 4,887,072 | 12/1989 | Kimura et al. | 340/691 |
| 4,952,931 | 8/1990 | Serageldin et al. | 340/902 |
| 5,023,592 | 6/1991 | Schumacher | 340/475 |
| 5,032,836 | 7/1991 | Ono et al. | 340/825 |
| 5,039,978 | 8/1991 | Kronberg | 340/384 |
| 5,185,833 | 2/1993 | Betts | 385/46 |
| 5,191,317 | 3/1993 | Toth et al. | 340/676 |
| 5,495,243 | 2/1996 | McKenna | 340/902 |

*Primary Examiner*—Jeffery Hofsass
*Assistant Examiner*—Daryl C. Pope
*Attorney, Agent, or Firm*—Stratton Ballew

[57] ABSTRACT

A signal translator that translates a device detectable signal into an electrical signal directed to an output that an operator with impaired hearing can perceive. Preferably, a detected signal is translated into a generated electrical signal directed to a loudspeaker. The loudspeaker then sounds a tone of a volume and a frequency selectable by an operator. Alternatively, the device detectable signal is a detected audio signal. The detected signal can also be a turn signal flasher of a vehicle. The detected signal is translated to a generated electrical signal transmitted to a loudspeaker. A strobe light from an emergency vehicle can also perform as the detected signal, when the invention includes an emergency vehicle signal decoder for discerning the strobe light from an emergency vehicle. The signal translator includes a trigger for translating a detected signal into a generated signal for transmission to an operator perceivable signal. The detected signal is detected by an optical pickup placed proximate a light source within a vehicle. The signal translator enables the operator of a vehicle who is hearing impaired or deaf to perceive the functioning of the vehicle's turn signal flasher. The signal translator enables the operator of a vehicle, who is hearing impaired or deaf, to more easily perceive normally audible signals and cues.

7 Claims, 3 Drawing Sheets

| FIG. 1A | FIG. 1B |
|---|---|

METHOD AND APPARATUS FOR A SIGNAL TRANSLATOR

TECHNICAL FIELD

The invention relates to a method and apparatus for translating an apparatus detectable signal to an operator perceivable signal, and more particularly to a signal translator method and apparatus for translating a detected signal, detectable by the signal translator, to a signal perceivable by an operator of the signal translator.

BACKGROUND OF THE INVENTION

The ability to drive a motorized vehicle for personal transport to a workplace, store, school or doctor's office is often a key element in the well being of a self-reliant person. For a person with a partial or total hearing loss, driving becomes a dangerous task. Because critical roadway information is obtained through the sense of hearing, a driver who is unable to hear the auditory signals and cues while driving is at a severe disadvantage. The hearing impaired driver will often quit driving because of the stress and danger involved. Without the ability to drive a motor vehicle, the freedom and mobility of a deaf person is curtailed.

Vehicle instrumentation often requires an attuned sense of hearing by the driver. For example, the operator of a vehicle can turn off a turn signal flasher when it is no longer required or activated inadvertently, because he is alerted to the turn signal's activation by the periodic audible click generated by the turn signal flasher. However, if the operator is hard of hearing, he may not hear the particular frequency of the audible click generated by the turn signal flasher. As a result, the driver is unaware that the turn signal flasher is still operating, until well after the driver has upset and confused fellow motorists. Unintentional operation of the turn signal may even cause accidents with other motorists, bicyclists and pedestrians who erroneously assume the turn signal is conveying the operator's intention to turn, when the operator is proceeding straight ahead without any intention of turning. Although the vehicle instrument panel has an indicator light to show that the signal is activated, the indicator light can easily go unnoticed for a length of time, especially during daylight hours, when the lights of the instrument panel appear dim. Therefore, a need exists for a device that enables the driver of a vehicle who is hearing impaired or deaf to easily perceive the operation of the vehicle's turn signal flasher.

The operator's timely perception of cues external to the vehicle is also vital. For example, emergency vehicles have flashing lights and sirens to signal all other vehicles to immediately yield. A hearing impaired driver may be unaware of the approaching emergency vehicle, and thus fail to yield to the emergency vehicle as required by law. If a driver misses these normally visible and audible indicators and cues, a significant safety hazard is created. The driver will have little legal recourse in compensation for damages that may result from this lack of awareness. Therefore, an additional need exists for a device that enables the operator of a vehicle who is hearing impaired or deaf to perceive normally audible signals and cues.

Several U.S. Patents teach the translation of various inputs to achieve an auditory output. U.S. Pat. No. 4,777,474 to Clayton discloses an alarm receiving system in a portable unit for a hearing impaired user. The Clayton device detects alarm signals from the electrical circuitry of an alarm device, such as a doorbell, smoke detector or a telephone. Clayton includes a radio alarm transmitter and a radio alarm receiver. The radio alarm receiver is incorporated into a hearing aid.

Other relevant patents include U.S. Pat. No. 4,209,767 to Flanders, which discloses an "acousto/optic coupler device" that uses a photo detector sensor for input to a system, and an acoustic output signal to warn and guide an aircraft landing. However, the Flanders system only teaches use with aircraft also includes a complicated light generating means sensitive to the vibration of the incoming aircraft.

In U.S. Pat. No. 4,424,458 to Buck et al., a proximity sensor is described which has a signal detector with set threshold levels related to a variable output audible frequency alarm. The Buck et al. signal detector is disclosed as an "opto-electronic system" which includes a photo-electronic device illuminated by an incoming light beam. Buck et al. only teaches using the device as a proximity sensor.

U.S. Pat. No. 4,887,072 to Kimura et al. discloses an audio alarm signal device. Multiple alarms can be selectively controlled to generate desired tones. Kimura et al. fails to teach the detection of optical signals or audio signals.

U.S. Pat. No. 5,158,833 to Betts discloses a fiber-optic input converted to an electrical output. Betts, however teaches its use only in a computer networking system.

SUMMARY OF THE INVENTION

According to the invention, a device detectable signal is translated into an electrical signal directed to an output that an operator with impaired hearing can perceive. In a preferred embodiment of the invention, a detected signal is translated into a generated electrical signal directed to a loudspeaker. The loudspeaker then sounds a tone of a volume and a frequency selectable by an operator.

In another preferred embodiment of the invention, the device detectable signal is a detected audio signal. The detected audio signal is translated to the generated electrical signal and directed to a loudspeaker. Additionally, the generated electrical signal has a volume and a frequency selectable by the operator.

In yet another preferred embodiment of the invention, the detected signal is a turn signal flasher of a vehicle. The detected signal is translated to a generated electrical signal transmitted to a loudspeaker.

In still another preferred embodiment of the invention, the detected signal is the strobe light from an emergency vehicle. Additionally, the invention includes an emergency vehicle signal decoder for discerning the strobe light from an emergency vehicle. When the emergency vehicle signal decoder detects an emergency vehicle, an electrical signal is generated. The generated electrical signal is directed to an output that an operator with impaired hearing can perceive.

According to one aspect of the invention, a signal translator comprises a trigger means for translating a detected signal into a generated signal for transmission to an operator perceivable signal. The detected signal is detected by an optical pickup placed proximate a light source within a vehicle.

According to another aspect of the invention, the signal translator enables the operator of a vehicle who is hearing impaired or deaf to perceive the functioning of the vehicle's turn signal flasher.

According to yet another aspect of the invention, the signal translator enables the operator of a vehicle, who is hearing impaired or deaf, to more easily perceive normally audible signals and cues.

According to still another aspect of the invention, the signal translator enables the operator of a vehicle, who is hearing impaired or deaf, to perceive warning signals from emergency vehicles.

DETAILED DESCRIPTION OF SPECIFIC EMBODIMENTS

The invention provides a signal translator that translates a signal detectable by the signal translator, to a signal detectable by an operator of the signal translator. This invention is especially suited for use by people who are hearing impaired. As shown schematically in FIG. 1A and FIG. 1B, the signal translator includes at least an optic pickup connected to a trigger. The optic pickup is preferably a fiber optic filament, but can alternatively be an omni-directional photo detector or a current sensor. The signal translator includes a triggering means for converting a detected signal from the optic pickup to an electrical signal. The electrical signal from the translator is directed to a loudspeaker. Any status light could be connected to the signal translator, from a turn signal flasher in a motorized vehicle, to a ready light on an appliance. A monitored light is translated by the signal translator to a warning tone at a volume and a frequency set by an operator of the signal translator. Selecting the frequency of the warning tone aids operators that have difficulty hearing certain frequencies of sound.

Alternatively, instead of an optical pickup, this device can translate an audio signal or an electrical signal to a warning tone of a specific frequency and volume, for warning a person who is vision or hearing impaired.

Figure 1A:
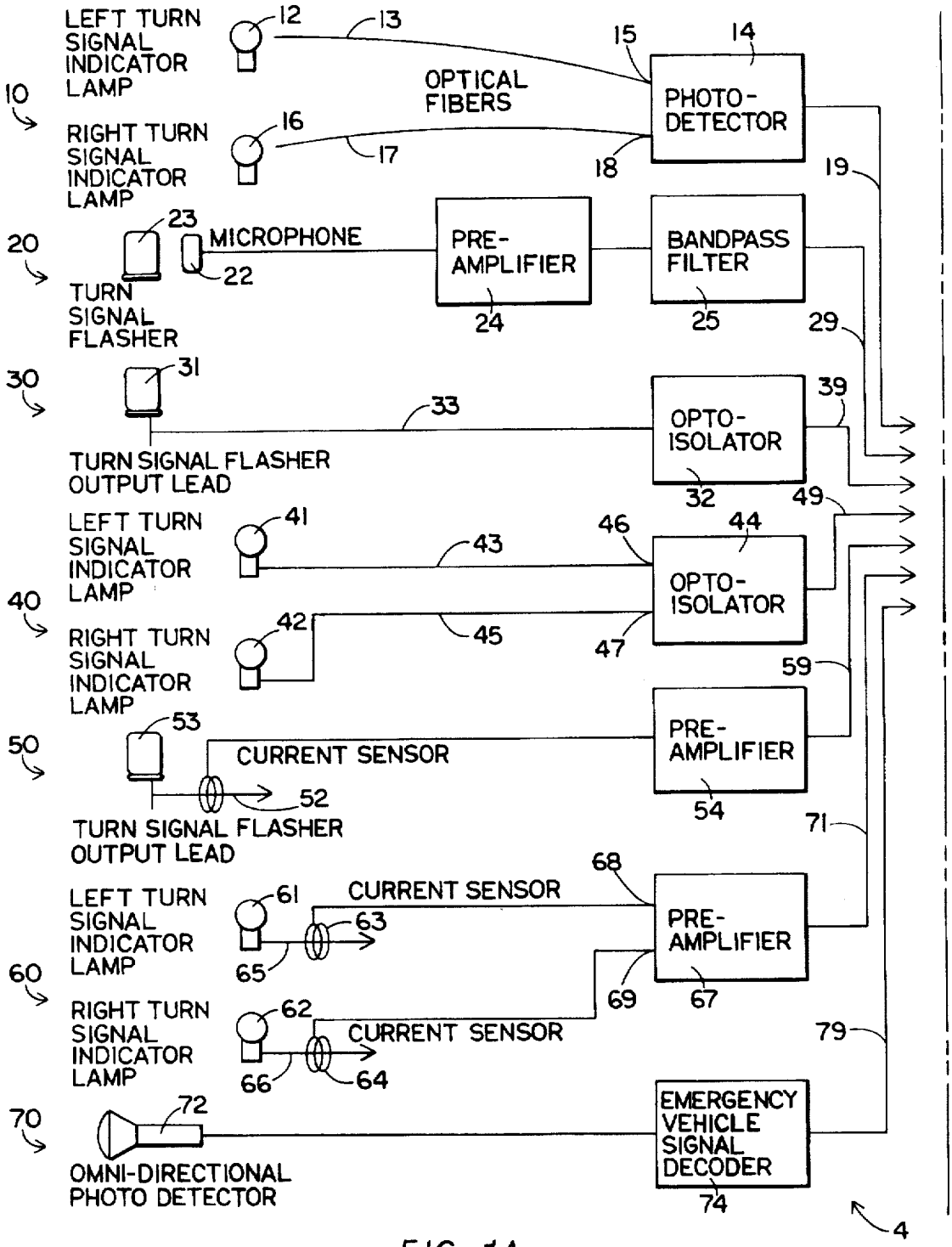
FIG. 1A is a schematic diagram of a signal translator, according to an embodiment of this invention.
Figure 1B:
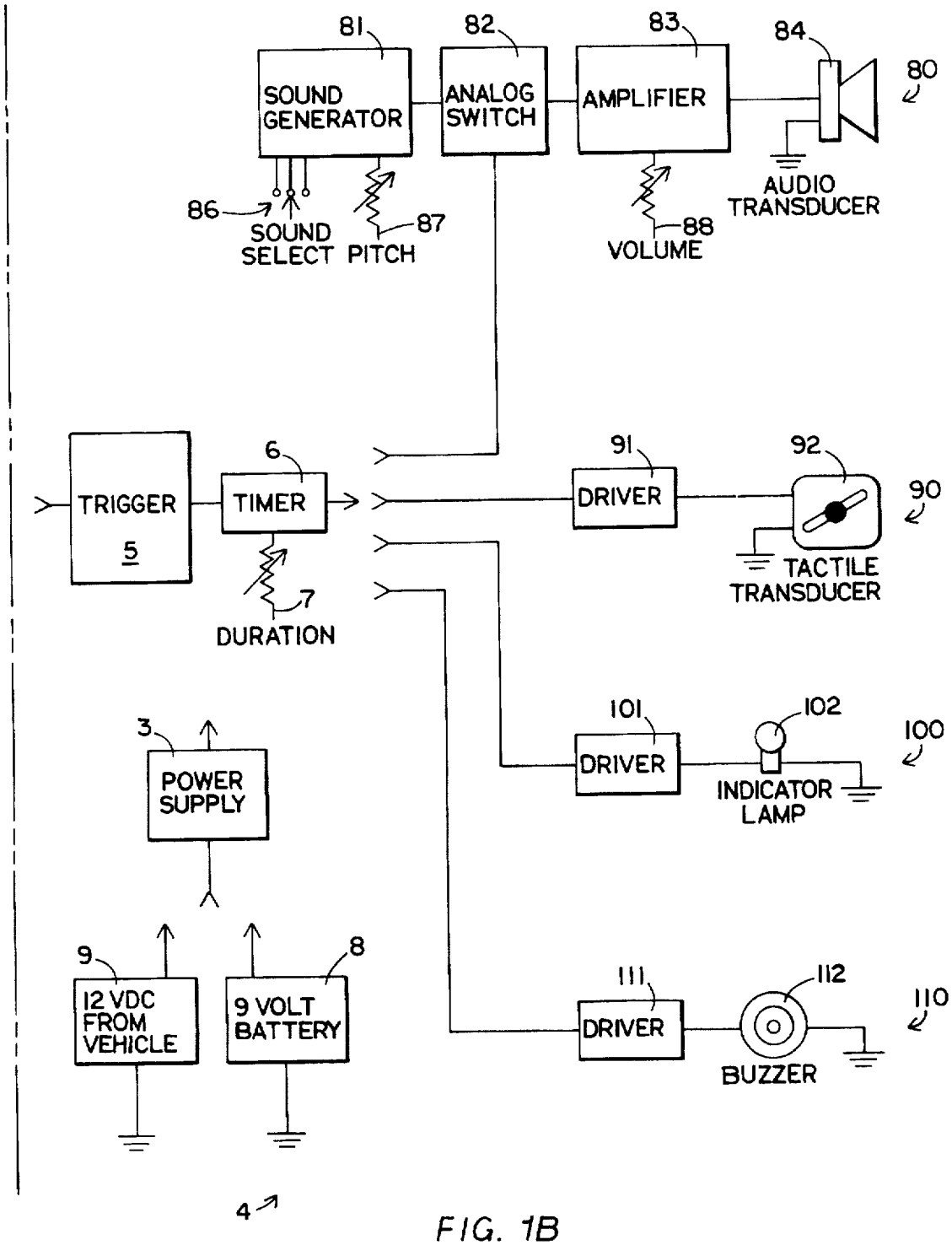
FIG. 1B is a schematic diagram of a signal translator, according to an embodiment of this invention.

A range of embodiments of the signal translator 4 are schematically shown in FIG. 1A and FIG. 1B. The trigger 5 is the central component of the signal translator. The trigger is preferably a circuit of known technology and standard configuration, typically used together with detectors of an electronic design. The trigger receives a detected signal from an input sensor and processes the detected signal into a generated signal. The trigger transmits the generated signal to an output generator, so that the generated signal is perceivable by the operator of the signal translator.

The trigger 5 processes the detected signal by receiving the detected signal that is above a predetermined threshold value, and sending a corresponding generated signal to activate the output generator that is detectable by the operator. This predetermined threshold value can be set by the manufacturer of the signal translator or controlled by the operator. The operator can raise or lower the threshold value by adjusting a trigger sensitivity control (not shown). The purpose of the threshold value is to reduce the instances of the trigger sending a generated signal when the detection signal is in error. When these extraneous detection signals do not exist, the threshold is not required and the trigger sensitivity control can be eliminated.

Preferably, the trigger 5 sustains the generated signal for as long as the detected signal is received. Alternatively, as shown in FIG. 1B, the trigger can be used with a timer 6 having a duration control 7. In this embodiment, the trigger sustains the generated signal for at a length of time selectable by the operator. When the selected length of time elapses, the timer stops the generated signal transmitted by the trigger.

As schematically shown in FIG. 1A and FIG. 1B, the signal translator can include several alternative signal detection means. In a first detection means 10 of the present invention, a first left turn signal indicator lamp 12, as found in most conventional vehicles, provides a first left light source. Light emanating from the first left turn signal indicator lamp is transmitted through a left optical fiber 13 to a photo-detector 14. Similarly, a vehicle's first right turn signal indicator lamp 16 provides a first right light source. Light emanating from the vehicle's first right turn signal indicator lamp is sensed by and transmitted through a right optical fiber 17 to the first photo-detector.

Preferably, the photo-detector 14 has a left input channel 15 and a right input channel 18. The photo-detector is connected to the trigger 5 by a first detection connection 19. When the left input channel of the photo-detector receives a light impulse from the left optical fiber 13, the photo-detector sends a first left detection signal to the trigger. Similarly, when the right input channel 18 of the photo-detector receives a light impulse from the right optical fiber 17, the photo-detector sends a first right detection signal to the trigger.

The first detection connection 19 is preferably an electrically conductive wire. Alternatively, the inventor conceives transmitting the first left detection signal and the first right detection signal to the trigger 5 by other pathways, such as solid state circuitry or remote infrared transmission.

For the preferred embodiment of the first detection means as described above, the photo-detector 14 is any appropriate electric circuitry that can distinguish between the light impulse from the left optical fiber 13 and the light impulse from the right optical fiber 17, and emit the first left detection signal or the first right detection signal, respectively. Alternatively, if the operator (not shown) of the signal translator 4 does not need to differentiate between the first left detection signal and the first right detection signal, the trigger can emit a singular combined generated signal.

A second detection means 20 as shown in FIG. 1A includes an audio microphone 22 that detects the audible signal from a second turn signal flasher 23. The second turn signal flasher is of a conventional design as typically found in vehicles (not shown). The second turn signal flasher typically includes a means for announcing the activation of the first turn signal flasher with a click, or similar sound, at a frequency close to the flashing of the first turn signal flasher.

The audio microphone 22 generates a second detection signal when the second turn signal flasher 23 is activated. The audio microphone is preferably connected to a second pre-amplifier 24 that increases the strength of the second detection signal as it is transmitted to a bandpass filter 25. The bandpass filter removes extraneous signals, above and below the frequency emitted by the second turn signal flasher. The bandpass filter is connected to the trigger 5 by a second detection connection 29. The trigger receives the second detection signal that has been amplified and filtered.

A third detection means 30 includes a third turn signal flasher 31 and a third opto-isolator 32. The third turn signal flasher has a third output lead 33 that passes through the third opto-isolator. The first opto-isolator is a known optical coupling circuit. When a third output signal from the third turn signal flasher is received by the third opto-isolator, a third light source (not shown) is energized within the third opto-isolator. A third light sensitive device (not shown), also within the third opto-isolator, receives light from the third light source and sends a third detection signal.

The third opto-isolator 32 is connected to the trigger 5 by a third detection connection 39. The third detection signal is transmitted to the trigger through the third detection connection. The third opto-isolator can be easily retrofitted by patching into an existing third turn signal flasher 31.

Similar to the third detection means 30, a fourth detection means 40 can be employed when a fourth left turn signal indicator lamp 41 and a fourth right turn signal indicator lamp 42 are present. A fourth left output lead 43 of the fourth left turn signal indicator lamp passes through to a fourth opto-isolator 44. Similarly, a fourth right output lead 45 of the fourth right turn signal indicator lamp also passes through the fourth opto-isolator. Similar to the third opto-isolator 32, the fourth opto-isolator is also a known optical coupling circuit.

Preferably, the fourth opto-isolator 44 has a fourth left channel 46 and a fourth right channel 47. The fourth left output lead 43 of the fourth left turn signal indicator lamp 41 connects to the fourth left channel of the fourth opto-isolator. Similarly, the fourth right output lead 45 of the fourth right turn signal indicator lamp 42 connects to the fourth right channel of the fourth opto-isolator. The fourth opto-isolator is connected to the trigger 5 by a fourth detection connection 49.

When the fourth left channel 46 of the fourth opto-isolator 44 detects a fourth left output signal from the fourth left turn signal indicator lamp 41, the fourth opto-isolator sends a fourth left detection signal to the trigger 5. Similarly, when the fourth right channel 47 of the fourth opto-isolator detects a fourth right output signal from the fourth right turn signal indicator lamp 42, the fourth opto-isolator sends a fourth right detection signal to the trigger.

A fifth detection means 50 uses a first current sensor 51 to monitor the induced magnetic field produced by a current flow through a fifth output lead 52. The fifth output lead is connected to a fifth turn signal flasher 53 and the fifth current sensor is connected to a fifth pre-amplifier 54. When the fifth current sensor senses current flow in the fifth output lead, the fifth current sensor sends a fifth detection signal to the fifth pre-amplifier. The fifth pre-amplifier is connected to the trigger 5 by a fifth detection connection 59. The fifth pre-amplifier amplifies the fifth detection signal and transmits an amplified fifth detection signal to the trigger.

Alternatively, in a sixth detection means 60, a sixth left turn signal indicator lamp 61 and a sixth right turn signal indicator lamp 62 are present. A left current sensor 63 and a right current sensor 64 can be respectively employed to generate a sixth left detection signal and a sixth right detection signal, respectively. The left current sensor is a conventional inductive sensor attached externally to the sixth left output lead 65 of the sixth left turn signal indicator lamp. Likewise, the right current sensor is a typical inductive sensor attached to the second right output lead 66 of the third right turn signal indicator lamp. The sixth left detection signal is transmitted from the first left current sensor to a third pre-amplifier 67. Similarly, the sixth right detection signal is transmitted from the right current sensor to the sixth pre-amplifier.

Preferably, the sixth pre-amplifier 67 has a sixth left input channel 68 and a sixth right input channel 69. The sixth left detection signal travels from the left current sensor 63 to the sixth left input channel of the sixth pre-amplifier. Also preferably, the sixth right detection signal travels from the right current sensor 64 to the sixth right input channel of the sixth pre-amplifier. The sixth pre-amplifier is connected to the trigger 5 by a sixth detection connection 71.

When the sixth left input channel 68 of the sixth preamplifier 67 receives the sixth left detection signal from the left current sensor 63, the sixth pre-amplifier sends an amplified sixth left detection signal to the trigger 5. Likewise, when the sixth right input channel 69 of the sixth pre-amplifier receives a sixth right detection signal from the right current sensor 64, the sixth pre-amplifier sends an amplified sixth right detection signal to the trigger.

In a seventh detection means 70, an omni-directional photo-detector 72 transmits a seventh detection signal to an emergency vehicle signal decoder 74. The omni-directional photo-detector is preferred because of its ability to sense light sources from any direction. The emergency vehicle signal decoder is connected to the trigger 5 by a seventh detection connection 79, and transmits an emergency vehicle seventh detection signal to the trigger, when the sensed seventh detection signal matches the characteristic criteria of an emergency vehicle strobe flasher (not shown).

After receiving a detected signal, the trigger 5 transmits a generated signal, preferably to a timer 6. The timer sustains the generated signal for a period of time as determined by a timer duration control 7. The timer is most preferably a conventional circuit, designed for this purpose and known in the art.

The trigger 5 and the timer 6 are preferably electrically powered. The electrical power source for the trigger and the timer is most preferably either a standard 9 volt electrical power cell 8, or a 12 volt direct current power source 9, typically found in vehicle electrical systems. Alternatively, a small transformer (not shown) can be employed to convert a standard household's 110 volt alternating current to 9 or 12 volt direct current. Preferably, the electrical power sources are converted by a power supply 3 to the electrical specifications required by the component circuitry of the signal translator 4 as described herein.

The various detection signals as received by the trigger 5 are translated into generated signals. FIG. 1A and FIG. 1B show several alternative generation means for processing the generated signal received from the trigger.

A first generation means 80 shown in FIG. 1B includes a sound generator 81 equipped with an analog switch 82, an amplifier 83 and an audio transducer 84. Preferably, a first generation connection 85 connects the timer 6 to the analog switch.

Alternatively, when the signal translator 4 does not require a timer 6, the first generation connection 85 can connect the trigger 5 to the analog switch 82. In the configuration as shown in FIG. 1B, a first generated signal from the timer is transmitted to the analog switch. The analog switch closes when it receives the first generated signal. When the analog switch closes, the sound generator sends a sound signal to the amplifier 83. The amplifier sends an amplified sound signal to the audio transducer 84. The audio transducer then emits a first operator perceivable audio signal. The amplifier preferably includes a volume control 88. The volume control allows the operator to increase or decrease the volume of the amplified signal.

Preferably, the sound generator 81 includes a sound selector 86. The sound selector alternates the type of sound signal generated by the sound generator. Sound signals that approximate bells, squawks, beeps or buzzes are considered. Also preferably, the sound generator includes a pitch control 87. The pitch control adjusts the frequency of the generated sound. The pitch control allows the operator to avoid frequencies that are difficult to hear or masked by background noises.

A second generation means 90 is also shown in FIG. 1B. The second generation means preferably includes a tactile transducer driver 91 and a tactile transducer 92. The tactile transducer driver converts a second generated signal received from the timer 6 into a tactile transducer signal. The tactile transducer signal is sent from the tactile transducer driver to the tactile transducer. The tactile transducer signal is specific for the particular tactile transducer selected by either the operator or the manufacturer of the signal translator 4. The tactile transducer vibrates a frequency perceivable by the operator and is usually placed on the surface of the operator's body (not shown).

A third generation means 100 is shown in FIG. 1B. The third generation means preferably includes an indicator lamp driver 101 and an indicator lamp 102. The indicator lamp driver converts a third generated signal received from the timer 6 into an indicator lamp signal. The indicator lamp signal is sent from the indicator lamp driver to the indicator lamp. The indicator lamp signal is specific for the particular indicator lamp. Preferably, the indicator lamp flashes so that the operator readily observes it.

A fourth generation means 110 is also shown in FIG. 1B. The fourth generation means includes a buzzer driver 111 and a buzzer 112. The buzzer driver converts a fourth generated signal received from the timer 6 into a buzzer signal. The buzzer signal is sent from the buzzer driver to the buzzer. The buzzer signal is specific for the particular buzzer. Preferably, the buzzer sounds at a volume and frequency readily perceived by the operator.

Most preferably, each driver is incorporated into the respective operator perceivable signal generators. The tactile transducer driver 91 is preferably incorporated within the tactile transducer 92; the indicator lamp driver 101 is preferably incorporated within the indicator lamp 102; and the buzzer driver 111 is preferably incorporated within the buzzer 112. Also, the sound generator 81, the analog switch 82 and the amplifier 83 are preferably combined into a single composite circuit element (not shown).

In alternative embodiments, the timer signal can also be tailored to the specific operator detectable signal generation device and the need for any additional drivers is eliminated. The tactile transducer driver 91 can be omitted if the conversion of the second generated signal into the tactile transducer signal is not required and the second generator signal can be transmitted directly to the tactile transducer 92. Also alternatively, the indicator lamp driver 101 can be omitted, if the conversion of the third generated signal into the indicator lamp signal is not required and the third generator signal can be transmitted directly to the indicator lamp 102. Additionally, the buzzer driver 111 can be omitted, if converting the fourth generated signal into the buzzer signal is not required and the fourth generator signal can be transmitted directly to the buzzer 112.

Figures 1, 2:
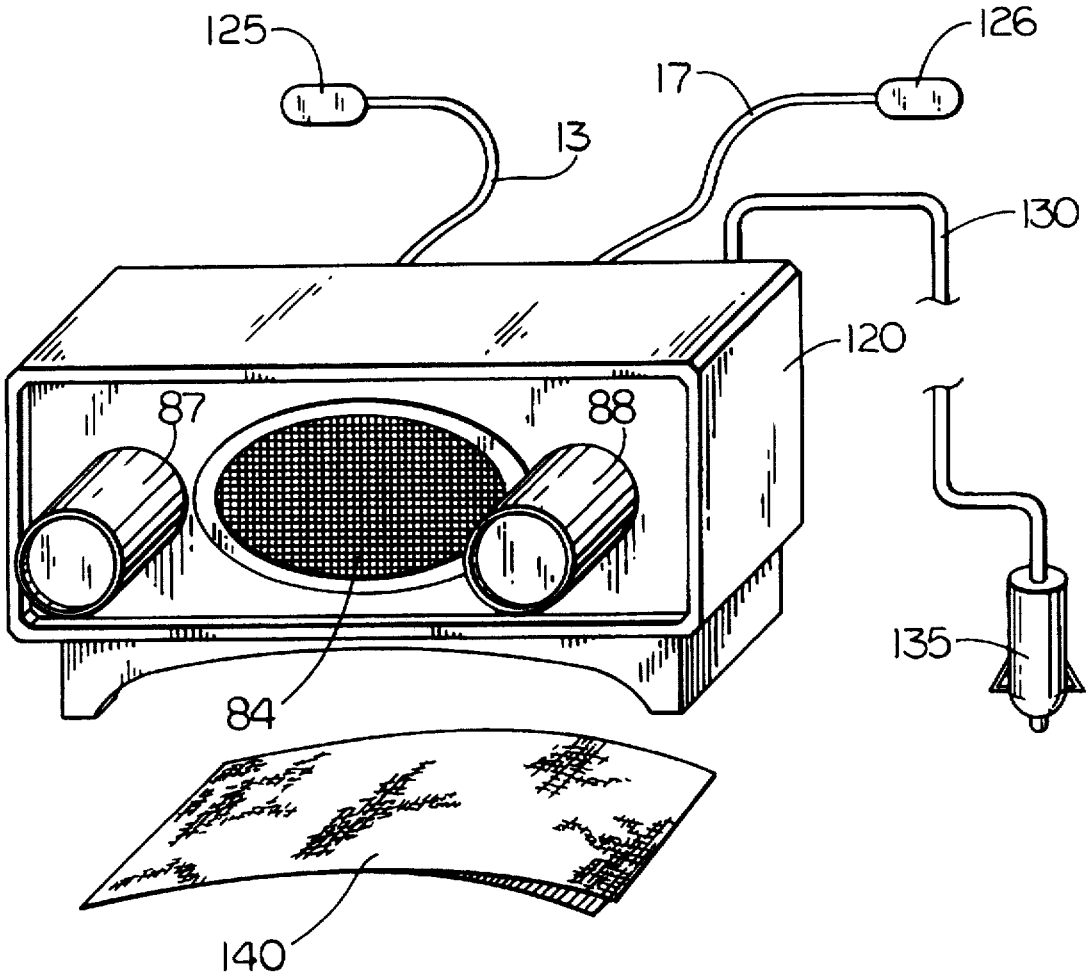
FIG. 1 shows the relationship between FIG. 1A and FIG. 1B.
FIG. 2 is a perspective diagram of a signal translator, according to an embodiment of this invention.

A specific embodiment of the present invention is shown in FIG. 2. The signal translator 4 is shown in a similar configuration to the first detection means 10, which employs the first photo-detector 14, as schematically shown in FIG. 1A. FIG. 2 also shows the signal translator in a similar configuration to the first generation means 80, which employs the audio transducer 84 as schematically shown in FIG. 1B.

The signal translator 4 shown in FIG. 2 is specifically suited for retrofit installation into a vehicle (not shown). The signal translator is enclosed in a housing 120 that contains the required circuitry and components as previously described.

A left optic pickup 125 is connected to the left optical fiber 13 and a right optic pickup 126 is connected to the right optical fiber 17. The left optic pickup and the right optic pickup are attached to the left turn signal indicator lamp 12 and the right turn signal indicator lamp 16 (as represented in FIG. 1A), respectively.

The source of power for the signal translator 4 is preferably either an internal 9 volt battery or a 12 volt direct current power supply, which is standard in many vehicles. A power cord 130 can connect to a vehicle's 12 volt direct current supply, preferably by plugging a power cord adaptor 135 into a standard cigarette lighter (not shown) of the vehicle (not shown). The signal translator is preferably mounted to a surface (not shown) within the vehicle, near the operator. A hook-and-loop type fastener 140 performs adequately.

An existing vehicle (not shown) can easily be retrofitted with the signal translator 4. The left and right optical pickups 125 and 126 of the preferred embodiment can easily be affixed directly on an instrument indicator (not shown). Alternatively, the audio microphone 22 of the second detection means 20 could be to use as an acoustic pickup to an existing flasher unit. The necessary circuitry and components of the present invention could be easily built into a new vehicle to interface a component similar to the second turn signal flasher 23 and position the controls for volume, frequency and sound selection 88, 87 and 86 respectively, in a position accessible to the driver.

In the preferred method of operation, the light impulse emanating from the first left turn signal indicator lamp 12 or the first right turn signal indicator lamp 16 enters the corresponding left optic pickup 125 or the right optic pickup 126, as shown in FIG. 2. The light impulse is transmitted by the left optical fiber 13 or right optical fiber 17, respectively, to the photo-detector 14. The photo-detector preferably converts the light impulse to the first left detection signal or the first right detection signal, respectively.

The first left detection signal, transmitted by the photo-detector 14 as a result of a light impulse received from the left optical fiber 13, can be equivalent to the first right detection signal, sent as a result of a light impulse received from the right optical fiber 17. Alternatively, as in the preferred embodiment, the light impulse received by the photo-detector from the left optical fiber causes the photo-detector to send of the first left detection signal to the trigger 5, and the light impulse received by the photo-detector from the right optical fiber causes the photo-detector to send the first right detection signal to the trigger.

The first detection signal is received by the trigger 5, translated into the first generated signal, and then transmitted to the analog switch 82. The analog switch closes when it receives the first generated signal. When the analog switch closes, the sound generator 81 sends a sound signal to the amplifier 83, which then sends an amplified sound signal to the audio transducer 84. The audio transducer then emits an operator perceivable signal.

The operator can adjust the volume control 88 to increase or decrease the volume of the audio transducer 84. The operator can also adjust the pitch control 87 to raise or lower the frequency of the sound emanating from the audio transducer.

The components to build a retrofit model of the apparatus exist as low cost discrete components, which can then be mounted on a personal computer type board. However, a custom designed dual in-line package (DIP) that has all of the required circuitry may be a more cost-effective employment of the present invention.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the claims that follow.

What is claimed is:

1. A signal translator comprising a trigger means for converting a detected signal into a generated signal, the detected signal detectable by an optical pickup placed proximately to a light source located within a vehicle, the light source comprising a manually activated turn signal indicator lamp, and the generated signal perceivable by an operator of the signal translator located within the vehicle.

2. The signal translator of claim 1 wherein the generated signal is an audio signal.

3. A signal translator comprising a translation means for translating a detected signal from an optical pickup to a generated signal directed to a loudspeaker for sounding a tone of a volume and a frequency selectable by an operator of the signal translator, the detected signal originating within a vehicle the detected signal including a light source comprising a manually activated turn signal indicator lamp.

4. The signal translator of claim 3, wherein said detected signal is an audio signal and the optical pickup is an audio pickup, the audio signal translated to said generated signal directed to said loudspeaker.

5. A signal translator comprising a translation means for translating a detected signal from an optical pickup to a generated signal directed to a loudspeaker for sounding a tone of a volume and a frequency selectable by an operator of the signal translator the detected signal discernable by the translation means, and differentiated as the detected signal originating from a left turn signal flasher of a vehicle versus the detected signal originating from a right turn signal flasher of the vehicle.

6. A method of optical translation comprising the steps of:

a) providing an optical pickup adjacent to an existing turn signal indicator lamp of a vehicle, the optical pickup located within the vehicle;

b) sensing a detected signal with the optical pickup;

c) transmitting the detected signal from the optical pickup to a trigger means;

d) translating the detected signal with the trigger means into a generated signal; and e) transmitting the generated signal from the trigger means to an operator of the vehicle.

7. A method of optical translation comprising the steps of:

a) transmitting a light impulse emanated from a lamp through an optical fiber to a photo-detector;

b) converting the light impulse to a first detection signal with the photo-detector;

c) sending the first detection signal to a trigger;

d) translating the first detection signal received by the trigger into a first generated signal;

e) sending the first generated signal to an audio transducing means for emitting an operator perceivable audio signal; and f) emitting the operator perceivable audio signal from the audio transducing means.

* * * * *